United States Patent [19]

Koziol et al.

[11] 4,022,679

[45] May 10, 1977

[54] COATED TITANIUM ANODE FOR AMALGAM HEAVY DUTY CELLS

[75] Inventors: Konrad Koziol, Rothenbach an der Pegnitz; Karl-Heinz Sieberer, Zirndorf near Nuremberg; Baptist Zenk, Rothenbach an der Pegnits, all of Germany

[73] Assignee: C. Conradty, Nuremberg, Germany

[22] Filed: Dec. 19, 1975

[21] Appl. No.: 642,384

Related U.S. Application Data

[63] Continuation-in-part of Ser. No. 468,632, May 9, 1974, abandoned.

[30] Foreign Application Priority Data

May 10, 1973 Germany ..... 2323497

[52] U.S. Cl. ..... 204/286; 204/219; 204/290 F

[51] Int. Cl.[2] ..... C25B 11/02; C25B 11/08; C25B 11/10

[58] Field of Search ..... 204/219, 290 R, 290 F, 204/286

[56] References Cited

UNITED STATES PATENTS

| | | | |
|---|---|---|---|
| 3,409,533 | 11/1968 | Murayama et al. | 204/219 |
| 3,458,423 | 7/1969 | Csizi | 204/290 F |
| 3,676,325 | 7/1972 | Smith et al. | 204/288 |
| 3,838,035 | 9/1974 | Pumphrey | 204/250 |
| 3,839,179 | 10/1974 | Koziol et al. | 204/219 |

FOREIGN PATENTS OR APPLICATIONS

| | | | |
|---|---|---|---|
| 1,076,973 | 7/1967 | United Kingdom | 204/290 F |

*Primary Examiner*—F.C. Edmundson
*Attorney, Agent, or Firm*—McGlew and Tuttle

[57] ABSTRACT

The anode is particularly designed for use at anodic densities $D_A$ greater than 10 kA/m$^2$, and comprises substantially horizontally extending coated anode segments having a clear spacing of at least 1.5 mm from each other and upwardly extending lateral surfaces. Each segment has an active coated part higher than 5 mm and not exceeding 20 mm, measured from the horizontal undersurface of the anode. The actual active surface of the parts, up to heights of 5 mm, 7.5 mm, 10 mm and 15 mm, respectively, exceeds at least 2.5, 3.33, 4 and 4.7 times, respectively, the projected anode area which latter is the total area bounded by the periphery of the anode. At least half the actual active surface extends upwardly relative to the horizontal base area of the anode.

7 Claims, 8 Drawing Figures

COATED TITANIUM ANODE FOR AMALGAM HEAVY DUTY CELLS

CROSS REFERENCE TO RELATED APPLICATION

This application is a continuation-in-part of Koziol et al application Ser. No. 468,632, filed May 9, 1974 and now abandoned.

BACKGROUND OF THE INVENTION

The present invention relates to a coated titanium anode for electrically highly loaded amalgam cells. The large amounts of chlorine gas developing on the anode in the high current loaded chlorine alkali electrolysis cells must be conducted away from the electrode range as quickly as possible, for energy conservation reasons.

As is well known, dwelling of the chlorine gas bubbles in the electrode range causes a substantial increase in cell voltage and a decrease of the current efficiency. This phenomenon, which has become known by the collective term "gas bubble effect", has, in past years, led to design changes in the graphite anode. For example, the horizontally arranged anode plates were provided with numerous slots and gas outlet openings, which did provide the desired effect up to current densities of $D_A = 10$ kA/m². However, the ceramic-like graphite anode of conventional design is beginning to be in the way of a further increase of the current density. Thus, at very high current densities, $D_A$, greater than 10 kA/$_m$2, it is difficult to remove the developed chlorine gas rapidly from the underside of the horizontal anode plate that itself is generously slotted and provided with very many gas outlet openings. The result is higher overvoltage on the graphite and greater voltage losses in the electrolyte enriched with chlorine gas bubbles. Moreover, with the number of slots and gas outlet openings, the inner resistance, the graphite loss and the sensitivity to transport of the anodes increase. It has been attempted to avoid this restriction by utilizing the graphite anode described in the German published application No. 2,029,640. This is an anode which is provided with a number of thin, vertical graphite plates, and in which the graphite plates are disposed transversely to the flow direction of the mercury density, corresponding in length to the cathode width, are slotted in a comb-like manner on their underside, and are provided on their upper side with sunk contact sleeves of anodic resistant material and, with the interconnection of trough-configured bellows of corrosion resistant elastomer, are connected with current distributor rails in such a manner that, with the exception of the graphite plate provided with sleeves, all current conducting parts remain excluded from the inside of the cell. Mercury cells equipped with this anode design and operated at current densities $D_A$ of 10 to 13 kA/$_m$2, really did let the voltage coefficient (k-value) drop below 0.11 (V.m²/kA), which appeared impossible for amalgam cells provided with electrographite anodes. Thus, the anodes in German published application No. 2,029,640 took a step toward the objective of making possible the intensified chlorine alkali electrolysis in modern amalgam cells with low voltage. However, an exact analysis of the wearing out picture of this anode simultaneously led to the conclusion that voltage coefficients $k$ smaller than 0.10 will remain unattainable in spite of further improvements of the graphite anode. The ridges (teeth) having a width of 12.5 mm and obtained by slotting the graphite plate having a thickness of 40 mm have become so pointed, as a result of the NaCl-electrolysis conducted at current densities between 10 and 13 kA/m², that the anode part facing the Hg-cathode soon has only prismatic teeth of a width of the sharply processed profile of about 10 mm and a profile height of about 15 mm. The anode ranges still further removed from the cathode also showed unusually strong traces of electrochemical attack. This wearing down appearance at a simultaneously favorable k-value is exceedingly surprising, considering it is similar to the wearing down appearance, which in many cases is briefly termed "Haifischzahne" (shark teeth), of horizontal graphite anode plates in NaCl-electrolytes contaminated by bringing in alkali, which always provides for high cell voltage in spite of strong pressing of the anodes. It must be concluded therefrom that the anode construction for high loaded amalgam cells, according to German published application No. 2,029,640, on account of its better chlorine gas bubble discharge, will distribute the electric current far better than the conventional stamp-configured, horizontally arranged anode plate provided with slots and gas discharge openings. It is still very effective in electrolysis, conducted at high current densities, down to great surface ranges, that it is to surface ranges that are 15 mm and more away from the ridge tips.

This important finding has to be taken fully into account in the development of an improved coated titanium anode or electrically highly loaded amalgam cells, particularly for utilization with anodic current densities $D_A$ greater than 10 kA/m².

Metal anodes for amalgam cells are well known in which the active part consists of coated titanium in the form of perforated sheet or metal mesh. These anodes lack the height and large surface necessary for good current distribution.

Moreover, metal anodes are known in which the active coating is applied onto a horizontally disposed parallel row of round titanium rods, which are held together by uncoated transverse ribs. Such anodes of thin, round titanium rods also lack the height necessary for good current distribution Although anodes produced from thick round rods do have the necessary height, the upper half of the activated rod surface, however, is in a position unfavorable relative to the mercury cathode, as it is in the shadow of the lower rod half. Current distribution to the activated surface of the upper rod half is further made difficult or, respectively, is entirely prevented by the extensive enrichment of the electrolyte, with chlorine gas bubbles in the narrow range of the gap between the round rods. Technical electrolysis tests with metal anodes, the active part of which consisted of completely coated titanium rods of a diameter greater than 5 mm, have shown, in the current density/range $D_A$ of 10 to 15 kA/m², that the anode process takes place almost exclusively on the rod surface facing the mercury cathode, and that by increasing the spacing between the round rods current distribution could not be substantially improved.

Furthermore, metal anodes are known in which the active part consists of thin titanium strips, which are disposed either perpendicularly or at any other angle relative to the cathode, and which are provided, on at least a part of their surfaces, with a coating consisting of a metal of the platinum metal group. For example, British Pat No. 1,076,973 discloses titanium anodes coated with platinum metal, the active part of which is present in the form of ribs or plates, respectively, which are disposed perpendicularly to the mercury cathode and parallel to the main direction of flow of the electric current and in the vicinity of which gas outlets or, respectively, gaps are disposed. The platinum metal coating is applied preferably or exclusively on the perpendicular area of the ribs or, respectively, plates, wherein at least half of the coated area and preferably at least 80% of the total coated area is arranged perpendicularly to the amalgam cathode, so that this coated area is about four times the area of the horizontal part of the coating. This measure is to counteract the danger of damage of the sensitive platinum metal coating by the amalgam in case of contact with the cathode. It also is to make possible operation of the anode at a spacing increased by about one mm from the cathode with the same cell voltage than with an anode produced from wire mesh, thus also reducing the danger of short circuiting. The important drawbacks of the suggested anodes include the small height of the active coating, amounting to only 2.54 mm, the unfavorable relation between the actual active surface of the anode and the projected surface of the anode at small distances with respect to the counterelectrode being at a maximum 2.03:1 and resulting from that construction of the anode, a complete absence of any active surface within the middle range and long distance range with respect to the amalgam cathode and, finally, the use of a collecting bar of titanium which has, because of its deep cross-slotting, only very small electrical conductivity, and the small actual active surface at small distances with respect to the counterelectrode.

SUMMARY OF THE INVENTION

It is therefor an object of the invention to provide an improved titanium anode for electrically highly loaded amalgam cells, particularly for use at anodic current densities $D_A$ greater than 10 kA/m² having a large height of the active coated part of the anode.

Another object is to provide such an anode having an extraordinarily large active coated area in the small distance range, the middle distance range and the long distance range, with respect to the counter electrode.

A further object of the invention is to provide such an anode having predominantly upwardly extending active coated lateral surfaces with respect to the amalgam cathode.

Another object of the invention is to provide such an anode having sufficiently large free space between the active surfaces that chlorine gas bubbles are not prevented from passing therethrough.

A further object of the invention is to provide such an anode having short current paths, low internal resistance and uniform current distribution.

Another object of the invention is to provide such an anode having a long life of its basic construction and its coating even if under high current overload.

A further object of the invention is to provide such an anode possessing good emergency operation conditions and re-use even after possible short circuits.

Yet another object of the invention is to provide such an anode possessing the ability of coating and re-coating without any problems, as well as the advantages of simplicity and inexpensiveness.

These objects are attained in a particularly advantageous manner by an anode comprising substantially horizontally extending completely coated anode segments having a clear spacing of at least 1.5 mm and upwardly extending lateral surfaces, and each having an active coated part higher than 5 mm and not exceeding 20 1 mm, measured from the horizontal undersurface of the anode, wherein the actual active surface of the parts, up to heights of 5 mm, 7.5 mm, 10 mm, and 15 mm, respectively, exceeds at least 2.5, 3.33, 4 and 4.5 times, respectively, the projected anode area which is the total area bounded by the periphery of the anode, and wherein at least half the actual active surface extends upwardly relative to the horizontal base area of the anode.

For an understanding of the principles of the invention, reference is made to the following description of typical embodiments thereof as illustrated in the accompanying drawings.

DESCRIPTION OF THE PREFERRED EMBODIMENTS

Figure 1:
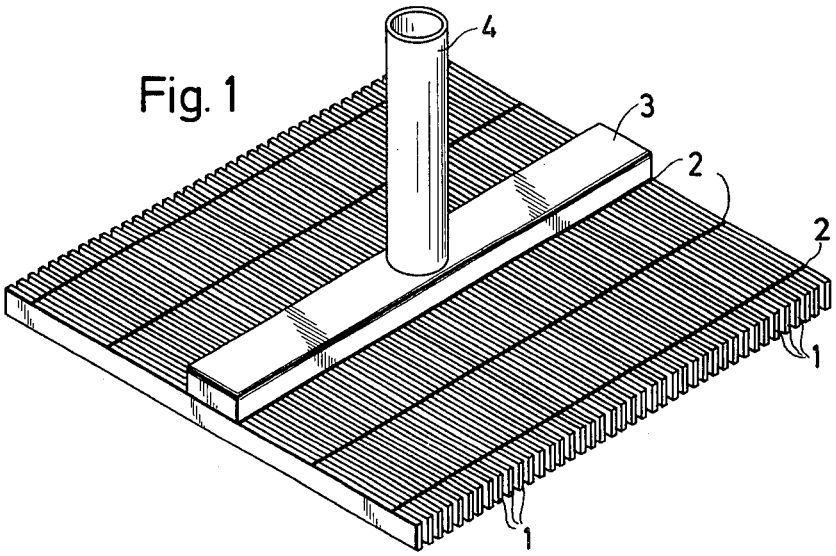
FIGS. 1, 2, 3 and 4 are perspective views of anodes embodying the invention.

FIG. 1 shows an anode, the active part 1 of which consists of completely coated, horizontally extending, vertically oriented titanium bands or strips of one mm thickness and 20 mm height. The spacing between the coated titanium bands, strips or segments amounts to 2 mm. The bands are connected with one another on their upper edges by several transversely extending welding seams 2. Current distribution is effected by a welded-on transverse bar 3 of uncoated titanium, and which is provided with a titanium protective tube 4 of the current feed line. This design results in the following ratios of the actual active surface to the anode area to be projected: height 5 mm, 3.67:1, height 7.5 mm, 5.33:1, height 10 mm, 7:1, height 15 mm, 10.33:1 and height 20 mm. 14:1. More than 95% of the actual active surface is, in this case, disposed perpendicular to the base area of the anode.

Figure 2:
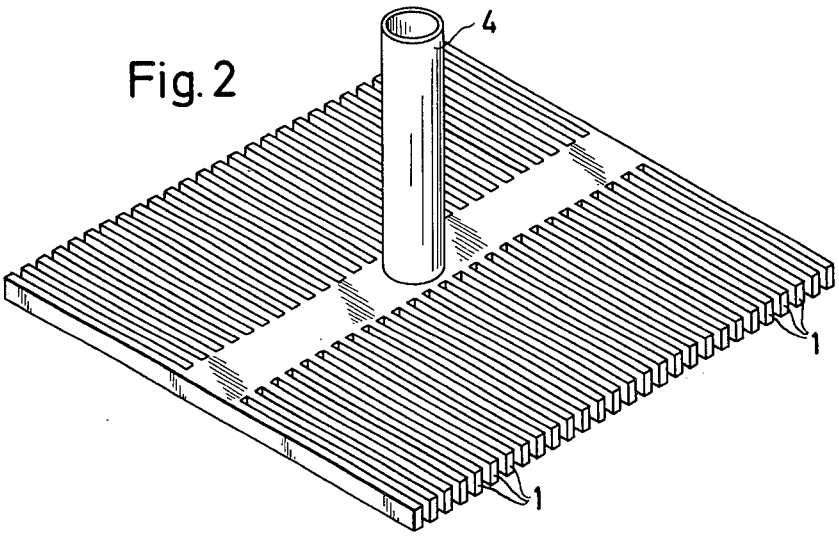

FIG. 2 shows an anode with a projected area 400 × 400 mm, the active part 1 of which consists of slotted and completely coated titanium sheet having a thickness of 12 mm. The width of the slots and segments amounts to 2.5 mm. The uncut center range of the active part, which simultaneously serves for current distribution, has a width of 60 mm and is provided on its underside with grooves having a width of 2.5 mm and depth of 2.5 mm. In the center thereof, the screw contact for the copper-current feed line is disposed, only the titanium protective sleeve 4 of which is visible.

In this case, the ratio of the actual active surface to the projected anode area amounts to 5.13:1 and about 80% of the actual active surface is disposed perpendicular to the base area of the anode.

Figure 3:
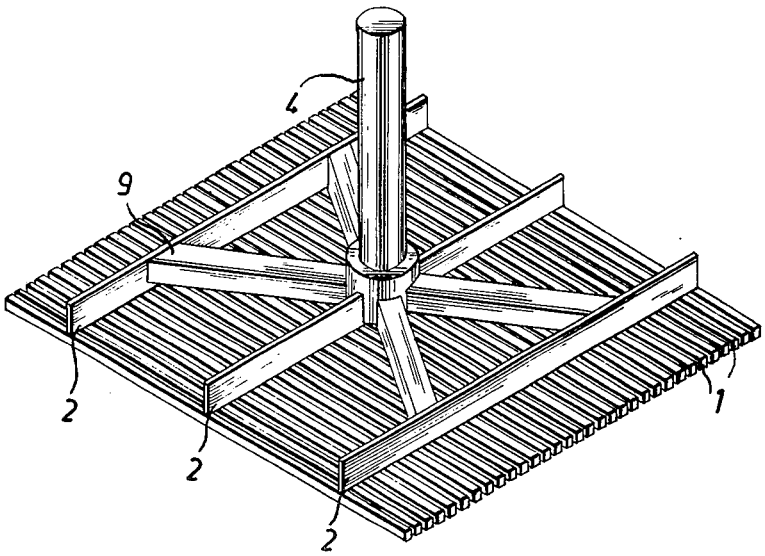

FIG. 3 shows an anode, the active part 1 of which, similarly to that of FIG. 1, is provided with perpendicularly oriented completely coated titanium bands or segments, having a clear spacing of 2 mm. The titanium bands, having a height of 7.5 mm and a thickness of 2 mm, are welded to retaining ribs which, in part, are connected, through titanium rods 9 of larger cross-section, with the contact sleeve in the center of the anode. This star-configured current distribution ensures a uniform load on the anode surface. From this anode a ratio of the actual active surface to the projected anode surface of 4.75:1 results.

Figure 4:
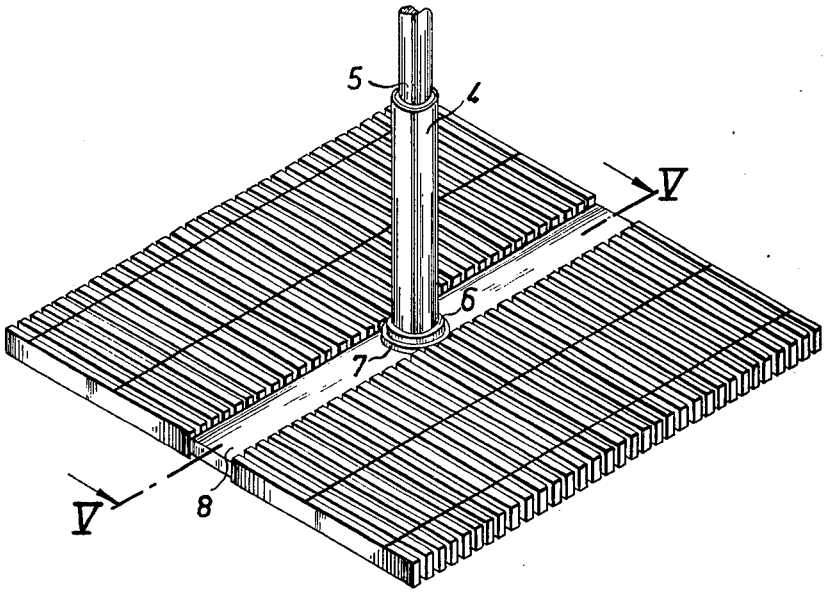

The titanium anode shown in FIG. 4, and provided with completely coated titanium bands or segments of a height of 20 mm and thickness of 1.5 mm disposed at a clear spacing of 2.5 mm, includes a central titanium sleeve 7 having a current distribution track 8 of titanium-plated copper to which the bands are welded. For safety reasons, the height ratio of the current distribution track to the height of the titanium bands amounts to 0.75:1.

Figure 5:
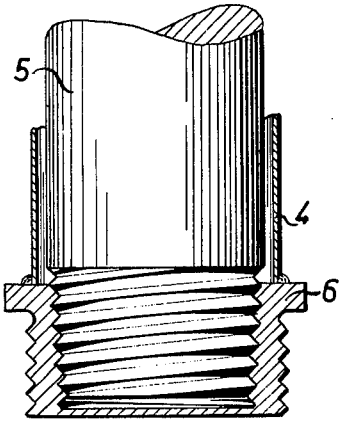
FIG. 5 is a sectional view disassembled, taken on the line V—V of FIG. 4.
Figure 5:
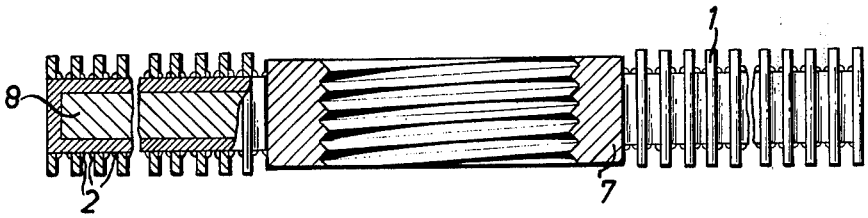

FIG. 5 shows a section through the anode according to FIG. 4 in which the type of contacting, of the copper current lead rod 5, through a closed titanium threaded member 6 having a flange and titanium protective tube 4, with the central titanium sleeve 7 of the anode, is shown in detail. The parts 6 and 7 have a thread with a large angle of thread or pitch, as according to German Pat. No. 1,237,482. Due to this design, the active part of the anode can be re-used by merely being unscrewed from the current feed means relative to the cathode. This is of particular advantage in case damage due to short circuits occurs on the anode underside, as well as also after a longer period of operation of the anode, in the course of which the active coating, in the zones disposed closer to the cathode, has been more extensively or entirely used up. The active coating of the upper zones which, in such cases is made less use of or, respectively, due to remoteness from the cathode is less used up, can still carry on the anode process for a long period of time after turning over the anode whereas, with conventional anodes, recoating will then have to be effected immediately.

Due to its features, the anode according to the invention for the first time provides for the possibility of a very extensive utilization of the current distribution and reduction of the anodic current density, thus resulting in a corresponding decrease of cell voltage.

Figure 6:
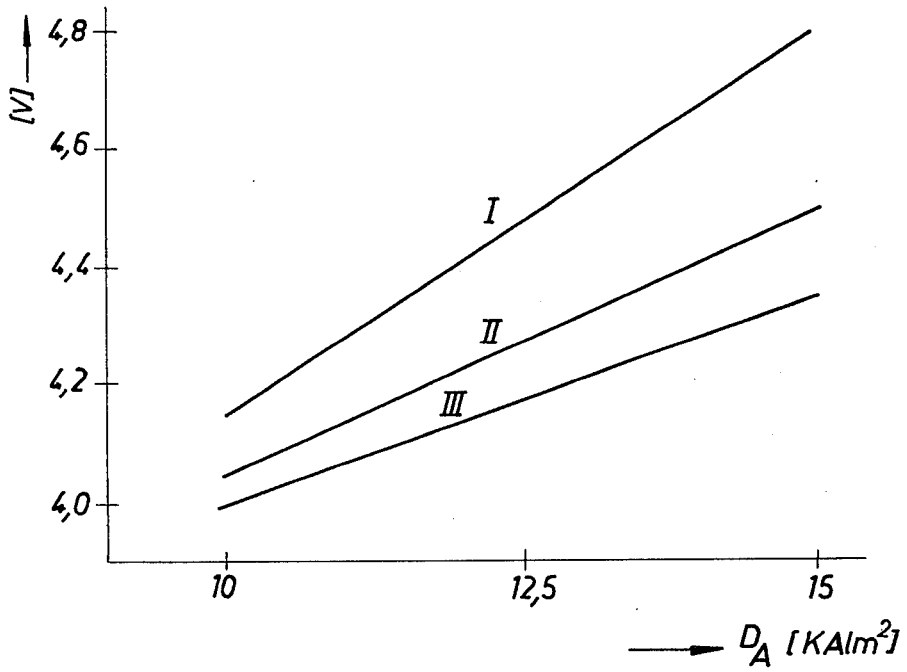
FIGS. 6 and 7 are graphical illustrations of the relation of the cell voltage to the anodic current density of anodes embodying the invention.

FIG. 6 shows a diagram of the cell voltage depending upon the anodic current density $D_A$ for three types of titanium anodes activated with the same substances of the type Me(I) ca 0.5 $Pt_3O_4$, wherein the curve designated I was obtained with titanium anodes of bands of 1 mm thickness and 10 mm height with a 3 mm wide gap between the bands and a coating height of 2 mm, and the curves designated II and III were obtained with titanium anodes with bands of 1 mm thickness and 15 mm height with the same gap and a coating height of 5 or, respectively, 10 mm. In each case, the spacing between the anode and the mercury cathode amounted to 3 mm.

Figure 7:
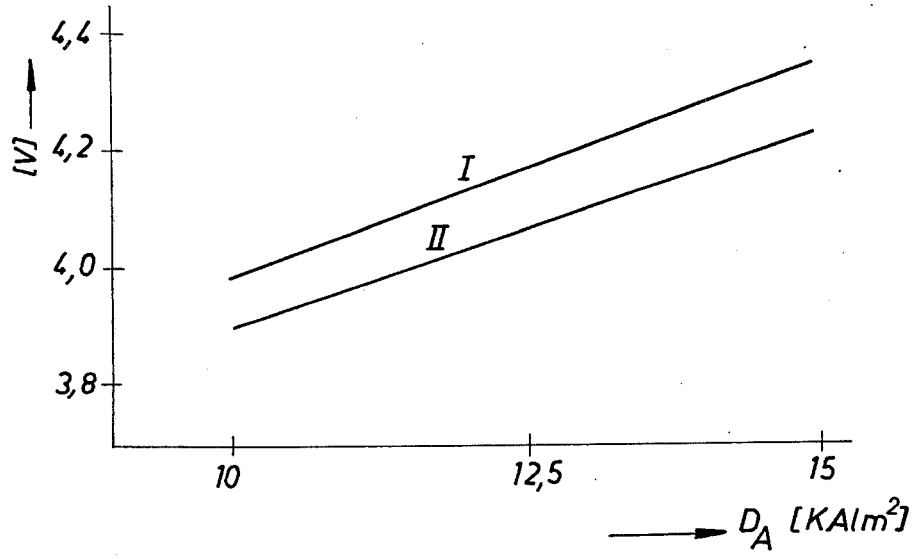

In the diagram shown in FIG. 7, there is disclosed the fact that the dependence of the cell voltage upon the anodic current density can be substantially improved by increasing the actual active surface in the range close to and remote from the cathode. Curve II corresponds to anodes whose active part consists of entirely coated titanium bands or segments having a 2 mm thickness and a 12 mm height with a 2 mm wide gap between the bands, whereas curve I concerns the same anode type as in FIG. 6 with a coating of 10 mm height.

Figure 8:
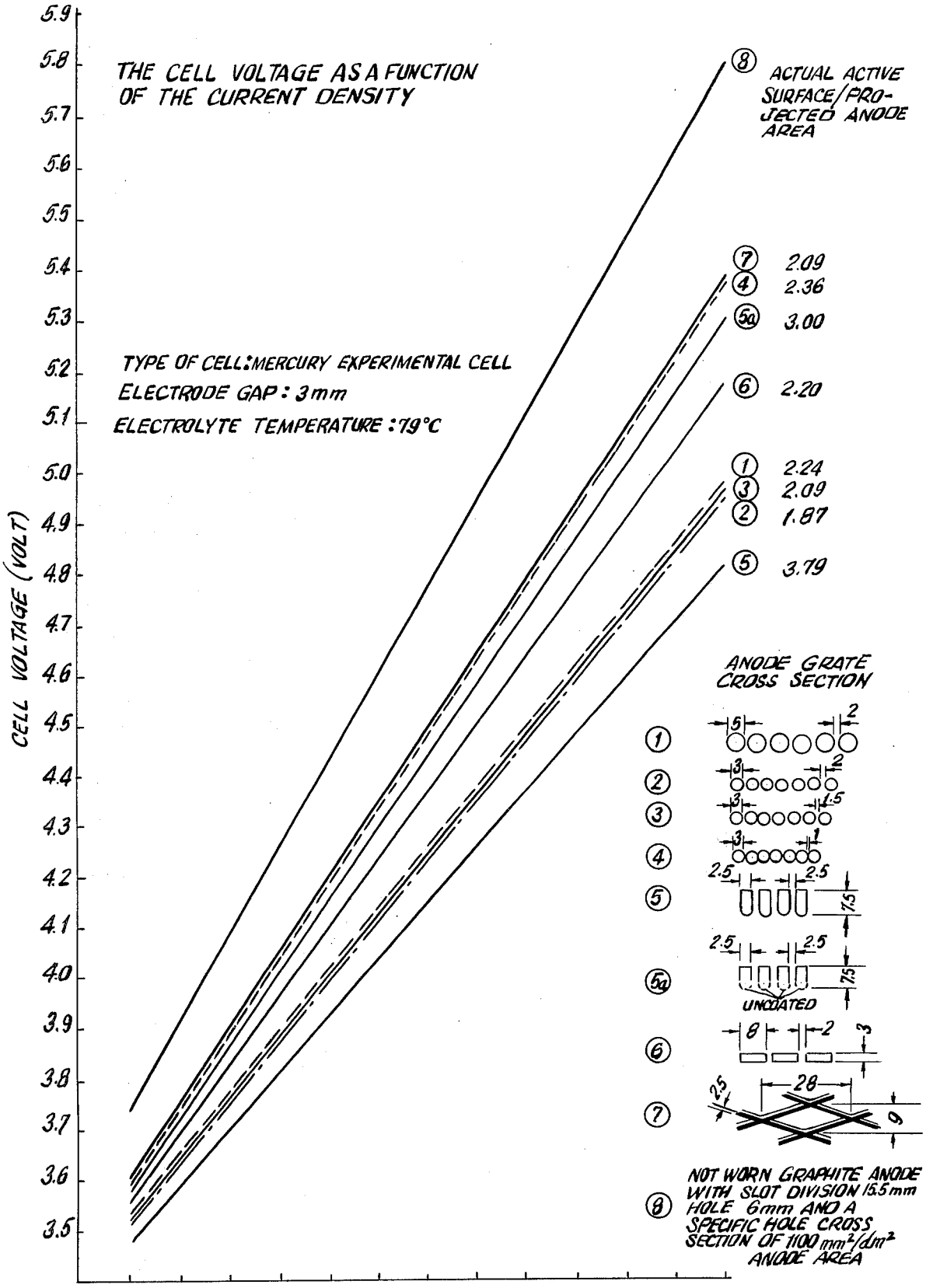
FIG. 8 is a graphical illustration of the cell voltage as a function of the current density, for various types of anodes.

FIG. 8 shows the cell voltage as a function of the current density and, in this connection, demonstrates that increasing of the actual active surface of an electrode does not at all always cause reduction of the cell voltage. In a test amalgam cell, operated with a sodium chloride electrolyte at a temperature of 79° C, several anode constructions of titanium differing from one another with respect to the form of the active anode part, were tested with respect to their voltage behavior in dependence on the anodic current density in the range of 3 to 15 kA/m² at a constant spacing of 3 mm between the anode and the cathode.

The configuration of the active anode grids of the test anodes, their cross sections of the gap, measured in percentage of the projected anode area, and the ratio of the actual active surface to the projected anode area can be readily observed in FIG. 8.

Thus in FIG. 8, it is indicated that anode No. 4, having a gap width of 1.00 mm and an actual active surface which is 2.36 times the projected anode area, is not favorable. The unfavorable voltage behavior of anode No. 4, having an actual active surface which is 13 percent greater than that of anode No. 3, is caused mainly by the chlorine gas bubble discharge being heavily impeded by the gap, which is 0.5 mm less than that of anode number 3. On the lower surface of the grid of anode number 4, large chlorine gas bubbles have been found over a broad range of current densities, and these bubbles cover about 25% of the lower grid surface.

However, FIG. 8 shows the essential advantages of anode number 5 with respect to the cell voltage. Anode number 5 was manufactured of coated titanium strips or segments having a height of 7.5 mm and a thickness of 2.5 mm. The advantages of anode number 5 are maintained even if the coating of the cathode, on that surface thereof which is directly opposite the grid surface, is destroyed. This effect has been simulated, during test, by grinding.

The reduction in current density by increasing the actual active surface further effects a corresponding increase in the life of the active anode coating. The large height of the electrochemically active part of the anode and the relatively small anode base area, and the primarily perpendicular arrangement of the active actual surface assure good emergency operation properties, also in the case of possible short circuits, and a rapid discharge of the chlorine gas bubbles. Finally, the large height permits accommodation of the current distribution within the active anode part, and thus the anode can, in a very simple manner, be used on both sides. The anode according to the invention thus meets entirely all requirements of secure and economical high current load operations. Thus, the active anode part, for instance, may also consist of coated titanium profiles other than the indicated strips or ribs, for example, round bars having a diameter greater than 5 mm, rods having elliptical cross-sections, strips rounded or tapered along one edge, and the like.

While specific embodiments of the invention have been shown and described in detail to illustrate the application of the principles of the invention, it will be understood that the invention may be embodied otherwise without departing from such principles.

What is claimed is:

1. A coated titanium anode for electrically highly loaded amalgam cells, particularly for use at anodic current densities $D_A$ greater than 10 kA/m², said anode comprising substantially horizontally extending completely coated anode segments having a clear lateral spacing of at least 1.5 mm and upwardly extending lateral surfaces, and each having an active coated upwardly extending part extending to a height of more than 5 mm and not exceeding 20 mm, measured from the horizontal undersurface of the anode, wherein the actual active surface of said upwardly extending parts, up to heights thereof of 5 mm, 7.5 mm, 10 mm and 15 mm, respectively, exceeds at least 2.5, 3.33, 4 and 4.5 times, respectively, the projected horizontal anode area which is the total area bounded by the periphery of the anode, and wherein at least half the actual active surface extends upwardly relative to the horizontal base area of the anode.

2. A coated titanium anode according to claim 1, in which the current distribution takes place within the active coated part, and which is provided with contact means for a current feed, the contact means having a structure such that both horizontal surfaces of the anode may be used by inverting the anode.

3. A coated titanium anode according to claim 1, in which said anode segments comprises coated, vertically oriented titanium bands having a thickness of 1 mm and a height of 20 mm, the clear space between said coated titanium bands being 2 mm.

4. A coated titanium anode according to claim 3, wherein said bands are connected with one another on their upper edges by several transversely extending welding seams, and wherein the current distribution is effected by a welded-on transverse bar of uncoated titanium.

5. A coated titanium anode according to claim 4, wherein said transverse bar of uncoated titanium is provided with a titanium protective tube of a current feed line.

6. A coated titanium anode according to claim 1, consisting of a slotted and coated titanium sheet.

7. A coated titanium anode according to claim 6, wherein said titanium sheet has a thickness of 12 mm, and the width of said slots is 2.5 mm.

* * * * *